US006601735B2

(12) United States Patent
Milian et al.

(10) Patent No.: US 6,601,735 B2
(45) Date of Patent: Aug. 5, 2003

(54) FLUID DISPENSER DEVICE

(75) Inventors: Alex Milian, Breteuil (FR); Yannick Pointel, Epegard (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 10/051,471

(22) Filed: Jan. 18, 2002

(65) Prior Publication Data

US 2002/0096539 A1 Jul. 25, 2002

Related U.S. Application Data

(60) Provisional application No. 60/265,961, filed on Feb. 2, 2001.

(30) Foreign Application Priority Data

Jan. 19, 2001 (FR) ..... 01 00976

(51) Int. Cl.[7] ..... B65D 83/00

(52) U.S. Cl. ..... 222/153.11; 222/153.13; 222/321.7; 222/402.11

(58) Field of Search ..... 222/153.11, 153.13, 222/321.7, 321.9, 380, 385, 402.11

(56) References Cited

U.S. PATENT DOCUMENTS

| | | | | |
|---|---|---|---|---|
| 3,422,996 A | * | 1/1969 | Lipman | 222/402.11 |
| 3,669,300 A | | 6/1972 | Thomas | |
| 3,797,705 A | | 3/1974 | Cooprider | |
| 3,827,605 A | | 8/1974 | Knickerbocker | |
| 3,827,606 A | | 8/1974 | Knickerbocker | |
| 4,024,988 A | * | 5/1977 | Starrett | 222/153.11 |
| 4,162,746 A | | 7/1979 | Anderson et al. | |
| 4,286,736 A | | 9/1981 | Corsette | |
| 4,318,498 A | | 3/1982 | Magers et al. | |
| 4,324,351 A | | 4/1982 | Meshberg | |
| 4,340,158 A | | 7/1982 | Ford et al. | |
| 4,343,417 A | | 8/1982 | Corsette | |

(List continued on next page.)

FOREIGN PATENT DOCUMENTS

| | | |
|---|---|---|
| EP | 0 187 374 A2 | 7/1988 |
| EP | 1 023 946 A2 | 8/2000 |

OTHER PUBLICATIONS

Figs. 1–4.
Figs. 1A, 2A, 3A, and 4A.
U.S. patent application of Peter J. Walters et al., Ser. No. 10/074,367, filed Feb. 12, 2002.
"Rapport De Recherche Préliminaire," EPO Form 1503, Sheet 1 of 1, and "Annexe Au Rapport De Recherche Préliminaire," EPO Form P0465, Sheet 1 of 1, for FR 0100976.

*Primary Examiner*—Joseph A. Kaufman
(74) *Attorney, Agent, or Firm*—Wood, Phillips, Katz, Clark & Mortimer

(57) ABSTRACT

A fluid dispenser device includes a dispenser member, such as a pump or a valve, having an actuator rod. A pusher is mounted to turn on and about the actuator rod and is provided with a dispenser orifice. The dispenser is actuated by applying pressure to the pusher. A fastening ring is provided for fastening the dispenser member on a receptacle. The ring has a fastening system for co-operating with a neck of the receptacle. The fastening ring includes at least one internal locking profile, and the pusher includes at least one locking member which can be engaged with the internal profile to prevent the pusher being actuated. The pusher has at least one inner bushing which includes the locking member. The pusher also has an outer skirt concentric with the inner bushing. The inner bushing defines the dispenser orifice. At least a portion of the inner bushing is received in the fastening ring. The pusher skirt is adapted to surround at least a portion of the fastening ring.

9 Claims, 2 Drawing Sheets

U.S. PATENT DOCUMENTS 4,355,962 A 10/1982 Magers
4,368,830 A 1/1983 Soughers
4,369,899 A 1/1983 Magers et al.
4,375,266 A 3/1983 Magers
4,384,660 A 5/1983 Pamisano et al.
4,424,919 A 1/1984 Knox et al.
4,479,589 A 10/1984 Ford
4,496,085 A 1/1985 Ford et al.
4,512,501 A 4/1985 Foster
4,538,748 A 9/1985 Ford et al.
4,589,574 A * 5/1986 Foster ..... 222/153.13
4,865,228 A 9/1989 Landecker
4,991,746 A 2/1991 Schultz
5,388,730 A 2/1995 Abbott et al.
5,445,299 A 8/1995 Harriman
5,615,806 A * 4/1997 Grothoff ..... 222/153.13
5,772,080 A 6/1998 de Pous et al.
5,829,641 A * 11/1998 Bartsch et al. ..... 222/153.13
5,918,774 A 7/1999 Lund et al.
6,006,949 A 12/1999 Foster et al.
6,053,371 A 4/2000 Durliat et al.
6,065,647 A 5/2000 Bliss, III et al.
6,119,902 A 9/2000 Shimada et al.
6,126,044 A 10/2000 Smith
6,173,863 B1 1/2001 Brozell et al.
6,186,364 B1 2/2001 Dobbs
6,186,365 B1 2/2001 DeJonge
6,193,112 B1 2/2001 Santagiuliana

* cited by examiner

LOCKED POSITION

UNLOCKED POSITION

FLUID DISPENSER DEVICE

CROSS REFERENCE TO RELATED APPLICATION

This application claims the benefit under 35 U.S.C. §119 (e) of U.S. provisional patent application Ser. No. 60/265,961, filed Feb. 2, 2001, and priority under 35 U.S.C. §119(a)–(d) of French patent application No. FR-01.00976, filed Jan. 19, 2001.

TECHNICAL FIELD

The present invention relates to a fluid dispenser device.

BACKGROUND OF THE INVENTION

One known fluid dispenser device comprises the following:

- a dispenser member such as a pump or a valve provided with an axially displaceable actuator rod;
- a pusher mounted to turn on and about the actuator rod, the pusher being provided with a dispenser orifice through which the fluid delivered by the dispenser member is dispensed when the pusher is pushed to drive the actuator rod into the dispenser member; and
- a fastening ring for fastening the pump or the valve on the neck of a receptacle generally provided with an outer thickening beneath which the fastening ring can engage with the help of fastening means.

That design is entirely conventional for a pump or a valve suitable for use in the fields of perfumery, cosmetics, or pharmacy. In general, the pusher is pushed in by means of a finger on one hand while holding the body of the dispenser by means of other fingers on the same hand. Naturally, such dispenser members are also to be found in other fields such as the food or chemicals industries.

As mentioned above, pressing the pusher has the effect of dispensing the fluid which is taken from the tank by the dispenser member. Consequently, before reaching the final user, the dispenser device can be actuated accidentally or deliberately so that the final user is not the first user. Furthermore, even when in the possession of the final user, the dispenser device can still be actuated accidentally, e.g. inside a handbag.

BRIEF SUMMARY OF THE INVENTION

The object of the present invention is to mitigate that drawback of unwanted actuation of the dispenser device by defining locking means that prevent actuation of the pusher.

To achieve this object, it is proposed that the fastening ring includes at least one internal locking profile and that the pusher includes at least one locking member engaged with said at least one internal profile to prevent the pusher being actuated. Advantageously, the internal profile comprises a locking bearing surface and a vertical actuation duct, the locking member being adapted to be moved selectively by turning the pusher about the actuation rod between a locked position in which the locking member bears against the locking bearing surface, and an actuation position in which the locking member is free to move vertically in the duct. Thus, any undesired actuation of the dispenser device is prevented while it is in storage, and the actuation position is easily reached merely by turning the pusher about the actuator rod of the dispenser member.

According to an advantageous characteristic, the ring has three internal profiles and the pusher has three locking members that are distributed at equal angles. Thus, the pusher rests in entirely stable manner on the ring in the locked position, and it is possible to press directly on the pusher to put the fastening ring into place on the neck of the receptacle. The locked position thus also becomes the position in which the dispenser device is assembled on the neck of the receptacle. This is advantageous when the fastening ring has snap-fastening tabs provided with snap-fastening heads which project inwards so as to be received beneath a thickening on the neck of the receptacle, a band of trim being mounted around the ring to prevent the tabs from deforming outwards. The thrust required for putting the ring into place on the neck of the receptacle, and more particularly for causing the snap-fastening heads to be received beneath the thickening on the neck can be exerted via the pusher when it is in the locked position. It then suffices to lower the band of trim onto the ring so as to ensure that the tabs are definitively prevented from deforming outwards and thus from escaping from beneath the thickening.

Naturally, other fastening techniques can be devised in which the ring alone suffices for fastening on the neck without active assistance from a band of trim, for example as in document WO 98/156688.

According to another characteristic, the pusher comprises at least one inner bushing provided with said at least one locking member and an outer skirt concentric with the inner bushing and defining the dispenser orifice, the bushing penetrating into the fastening ring and the skirt being adapted to surround the fastening ring. In addition, the pusher can be provided with a covering cap engaged around the skirt.

Because the pusher is entirely stable on the ring while in the locked position, given the presence of three bearing points, it is possible to mount the ring on the neck of the receptacle by using the pusher as a thrust transmission member. This is possible in particular when the ring alone serves to provide definitive fastening on the neck.

According to another characteristic of the invention, the internal profile defines at least one hard click at the bearing surface, the hard click being placed on the path of the locking member. The hard click can be integrated in the bearing surface or can extend vertically on the edge of the bearing surface. Advantageously, a hard click is situated between the bearing surface and the duct. In a variant or in addition, a hard click can be situated at an end of the bearing surface remote from the duct in order to define an end socket for the locking stroke. The hard clicks enable the user to distinguish clearly between the locked position and the unlocked position.

The invention is described in greater detail below with reference to the accompanying drawings showing two embodiments of the invention as non-limiting examples.

DETAILED DESCRIPTION

Figure 1:
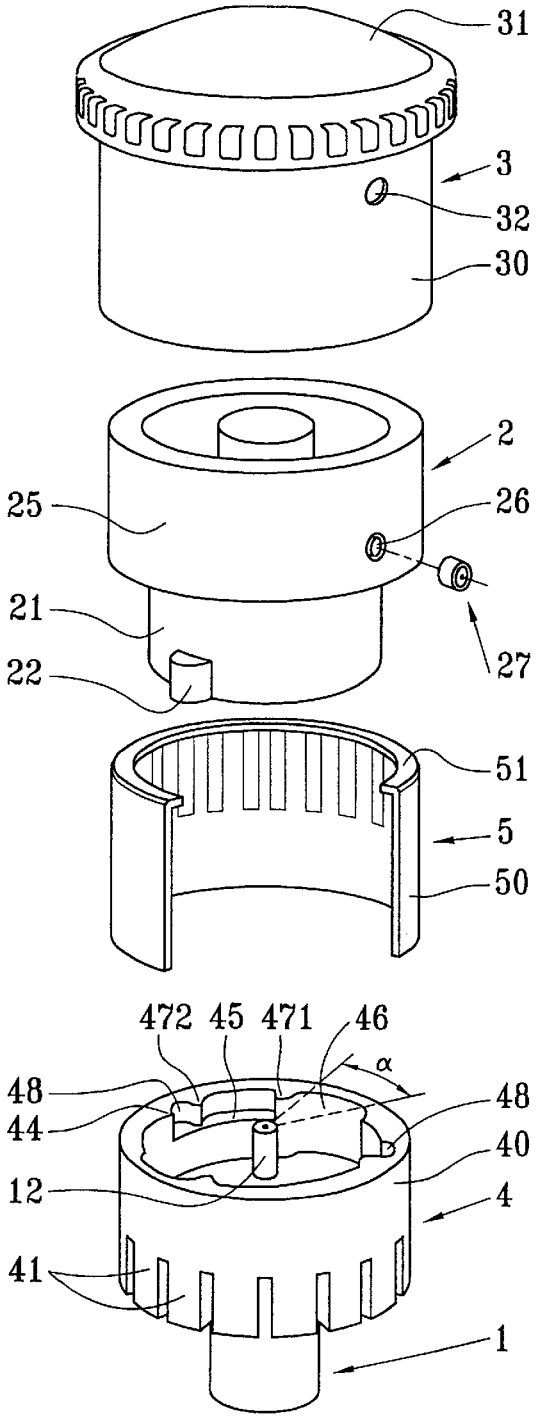
FIG. 1 is an exploded perspective view seen slightly from above showing a dispenser device constituting a first embodiment of the invention.
Figure 2:
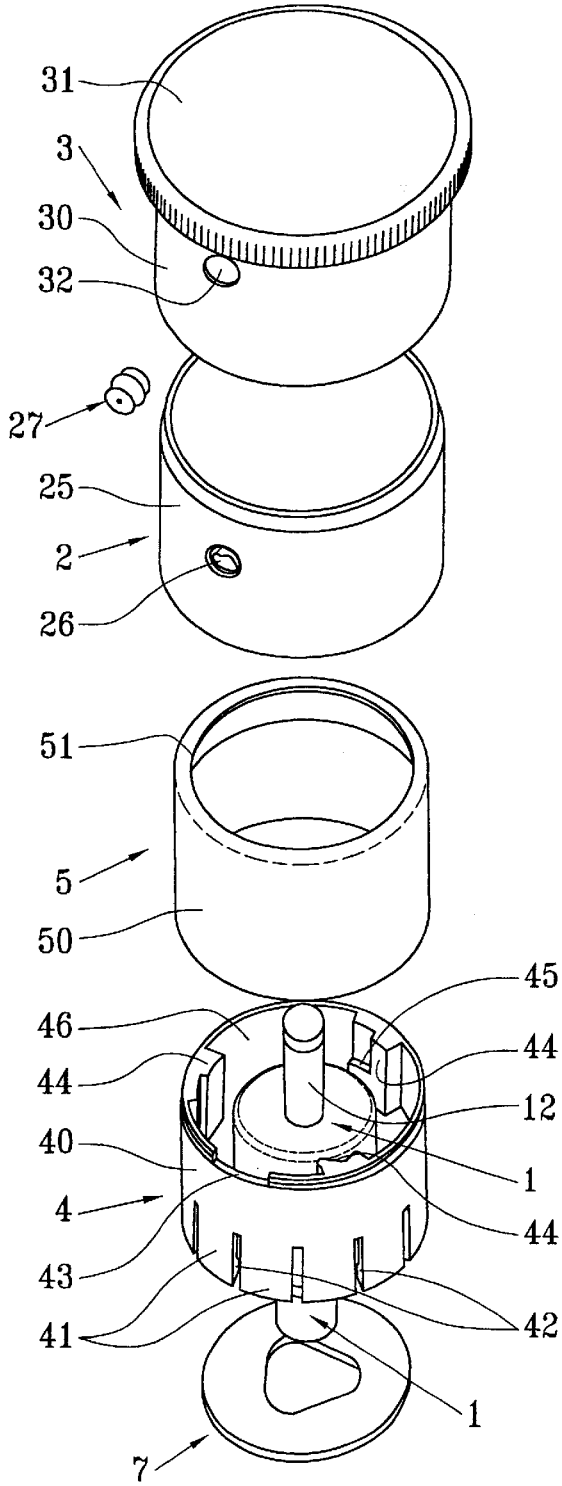
FIG. 2 is a view similar to FIG. 1 for a second embodiment of the invention.

In both of the embodiments shown in FIGS. 1 and 2, the fluid dispenser device of the invention comprises three essential component elements, namely: a dispenser member 1; a fastening ring 4; and a pusher 2. Once mounted on a receptacle 6, advantageously provided with a neck 60, the assembly can be referred to as a fluid dispenser. The present invention relates more particularly to the dispenser device, i.e. the top portion of the dispenser which is generally referred to by the term "dispenser device" since it includes the working equipment of the dispenser, i.e. a pump or a valve.

The dispenser member 1 can be a pump or a valve. In order to simplify the description below, it is assumed that the dispenser member is a pump. The pump 1 comprises a body 10 forming a top collar 11 which projects outwards. Beyond the body 10, the pump is formed with an actuator rod 12 which projects upwards and which is axially movable by being pushed into the body 10. A valve can be completely identical in outside shape. The detail concerning the internal structure of the pump is not described herein, given that it is not critical for the present invention.

The fastening ring 4 serves both to hold the pump 1 and to fasten it on the neck 60 of the receptacle 6. For this purpose, the ring 4 has a reception housing 49 for receiving the projecting collar 11 on the body 10 of the pump 1 as a force snap-fit. That is merely one possible embodiment, but it is conventional: nevertheless, the present invention is not limited to that particular embodiment of the means for holding the pump 1 in the fastening ring 4. All around the reception housing 49, the fastening ring 4 forms a substantially cylindrical sleeve 40. The bottom portion of the sleeve 40 is formed in this case with tabs 41 which extend vertically downwards and which are disposed side by side with intervening vertical slots. On the inside, these tabs 41 are formed with snap-fastening heads 42 disposed substantially at their bottom free ends. These snap-fastening heads 42 are for engaging beneath a thickening 61 that projects outwards on the neck 60 of the receptacle 6, as can be seen in FIG. 2. That is entirely conventional for the design of a receptacle neck. The snap-fastening heads 42 are thus received beneath the thickening 61, given that the snap-fastening tabs 41 are separated from one another by vertical slots so as to ensure they are somewhat resilient and can deform radially outwards so as to allow the heads of the tabs to pass over the thickening 61. As soon as the snap-fastening heads 42 come below the thickening 61, the snap-fastening tabs 41 can return to their initial substantially cylindrical position because of their elastic memory. Nevertheless, in order to guarantee that the heads remain locked beneath the thickening 61, a band of trim 5 is also used that has a substantially cylindrical body 50 terminated at its top end by an inwardly extending rim 51. This band of trim 5 is mounted around the sleeve 40 of the ring 4, e.g. by force engagement, such that the cylindrical body 50 prevents the tabs 41 from deforming radially outwards once the snap-fastening heads 42 are engaged beneath the thickening 61. The heads 42 are thus prevented from disengaging from beneath the thickening 61. It is clear that with this fastening technique, it is necessary to proceed in two stages: during a first stage, the ring is mounted on the neck of a receptacle so as to engage the snap-fastening heads beneath the thickening 61, and during a subsequent, second stage the band of trim 5 is mounted on the ring so as to ensure that the ring is definitively secured beneath the thickening 61 of the neck 60. That particular fastening technique is well known in the prior art.

It is also possible to envisage a ring having a continuous, non-split skirt which presents internal bulges or a snap-fastening bead for engagement beneath the thickening on the neck. A band is then not required for locking the ring onto the neck. It is then possible to use the pusher for transmitting the force required for snap-fastening the ring onto the neck of the receptacle. The substantially cylindrical sleeve 40 of the ring 4 also extends upwards above the snap-fastening tabs 41. On the inside, the sleeve 40 defines locking profiles. In the two embodiments shown in FIGS. 1 and 2, there are three locking profiles, however it is entirely possible to envisage other embodiments having one, two, or more than three locking profiles. The three locking profiles are advantageously distributed at equal angles around the periphery of the internal wall of the cylindrical sleeve 40.

Each locking profile has a locking bearing surface 45 and a vertical actuator duct 46. The locking bearing surface 45 is formed by a step formed in the inside wall of the cylindrical sleeve 40, and the actuator duct 46 is formed by a recess or a reduction in the thickness of the inside wall of the cylindrical sleeve 40. This structure is common to both of the embodiments shown in FIGS. 1 and 2. Each locking profile also comprises an abutment wall 44 at an end of the bearing surface 45 remote from the vertical duct 46. In the embodiment shown in FIG. 1, the locking profile is also formed with two hard clicks 471 and 472. The first hard click 471 is placed between the duct 46 and the bearing surface 45. The second hard click 472 is situated close to the end of the surface 45 that is remote from the duct 46 and beyond it forms an end of locking stroke housing 48. In this case, the two hard clicks 471 and 472 are formed vertically on the edge of the bearing surface 45, but it would also be possible for the hard clicks to be formed so that they project vertically from the bearing surface 45. In the embodiment of FIG. 2, the top edge of the cylindrical sleeve 40 is formed with a notch 43.

Figure 3:
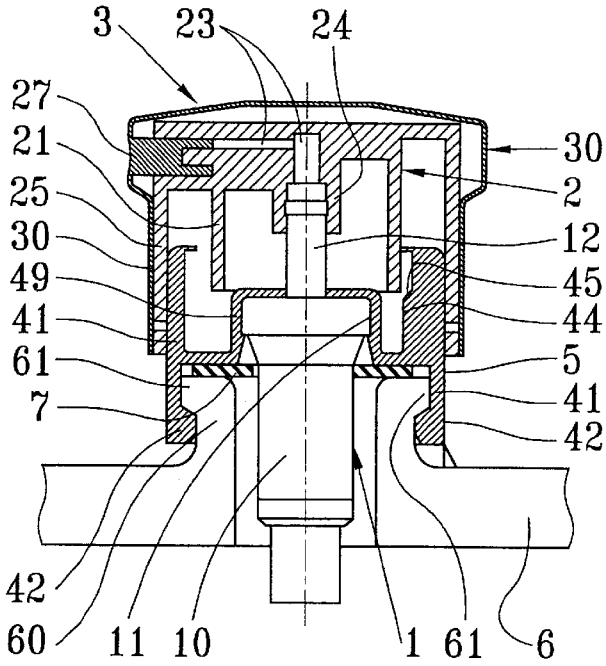
FIG. 3 is a vertical cross-section through a dispenser device as shown in FIG. 1 or 2 engaged on the neck of a receptacle.

To fasten the ring on the neck of the receptacle, it is advantageous to use a neck gasket 7 placed between the ring and the top end of the neck, as can be seen in FIG. 3.

The pusher 2 comprises an inner bushing 21 and an outer skirt 25 which extends coaxially around the bushing 21. The bushing 21 and the skirt 25 are connected together at their top ends. The pusher 2 also forms a connection sleeve 24 enabling the pusher to be mounted on the free end of the actuator rod 12 of the pump 1. This connection sleeve 24 is extended by a duct 23 which is connected to a dispenser orifice, implemented in this case in the form of a nozzle 27 engaged in a nozzle housing 26. The nozzle housing 26 is formed in the outer wall of the skirt 25.

In the embodiments of FIGS. 1 and 2, the pusher 2 has a covering cap 3 essentially for appearance purposes. The covering cap 3 comprises a substantially cylindrical body 30 pierced by an opening 32 for passing the nozzle 27. The cap 3 also has a top bearing surface 31 on which thrust is exerted by means of a finger to actuate the pump 1. The cap 3 is engaged on the pusher 2 with a friction fit between the inside of the cylindrical body 30 and the outer wall of the skirt 25, thereby ensuring that the cap is secured to the pusher 2. It should be observed that the bottom end of the cylindrical body 30 of the cap 3 can extend beneath the bottom end of the skirt 25, as in the embodiment of FIG. 1.

In the invention, the bushing 21 of the pusher 2 extends inside the cylindrical sleeve 40 of the ring 4 while the skirt

25 extends outside, and advantageously around the cylindrical sleeve 40 of the ring 4. This can be seen clearly in FIG. 3. In other words, the skirt 25 of the pusher 2 or the body 20 of the cap 3 masks at least the top portion of the cylindrical sleeve 40 of the ring 4.

On its outer surface, the bushing 21 engaged in the sleeve 40 has three locking members 22 which in this case are in the form of vertical ribs or splines. These locking members 22 are likewise distributed at equal angles around the outer periphery of the bushing 21. Given that the pusher 2 is mounted to turn on and about the actuator rod 12 of the pump 1, the locking members 22 can be turned about the actuator rod 12. In the invention, the bottom ends of these locking members 22 co-operate with the locking bearing surfaces 45 formed inside the sleeve 40 of the ring 4. When the locking members 22 are disposed in register with the bearing surfaces 45, the pusher cannot be pushed down and consequently the pump cannot be actuated. In contrast, by turning the pusher 2 so as to bring the locking members 22 in register with the vertical ducts 46, the pusher 2 can be pushed down in order to actuate the pump. In the embodiment of FIG. 1, in order to go from the surface 45 to the duct 46, and back again, the rib 22 formed on the bushing 21 must pass over the hard click 471 placed between the duct 46 and the bearing surface 45. This hard click 471 which provides a hard point when turning the pusher on the ring is clearly perceived by the user and as a result the user knows exactly when the rib is in the duct 46 or on the surface 45. The second hard click 472 performs the same function of providing a hard point in turning that is felt by the user, except that this hard click 472 defines the entrance to an end socket 48 for the locking stroke, with the rib 22 being received in the socket. The user then knows that the dispenser device is in a safe locked position.

Figure 5A:
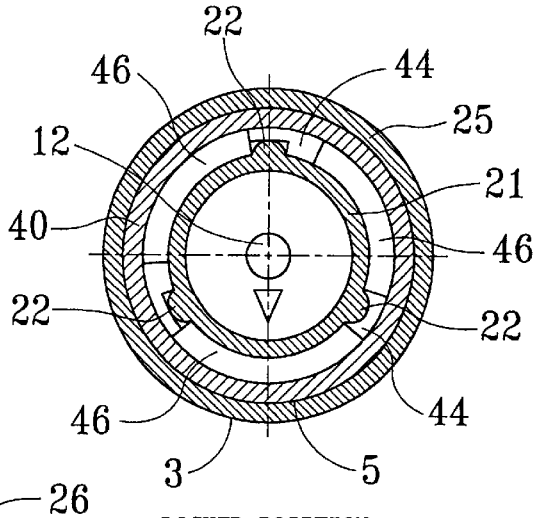
FIGS. 5*a* and 5*b* are horizontal cross-section views through a FIG. 2 dispenser device respectively in its locked position and in its unlocked position.
Figure 4:
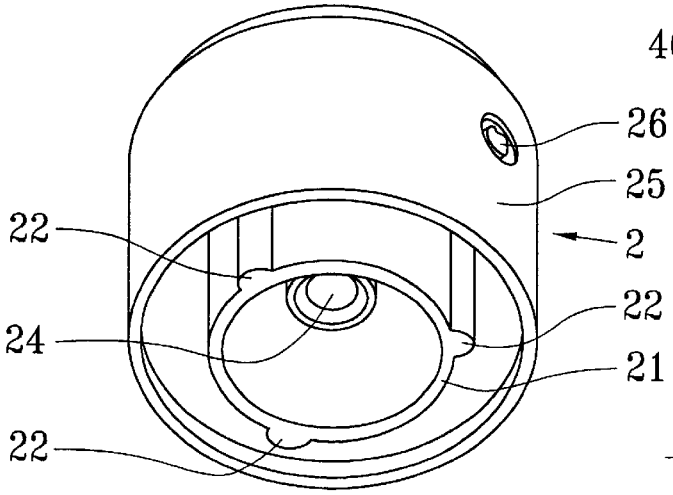
FIG. 4 is a perspective view seen slightly from below showing the pusher of FIG. 2.
Figure 5B:
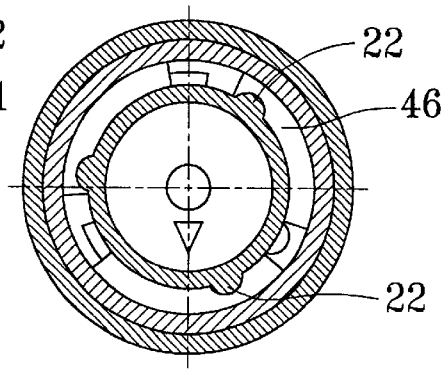

FIGS. 5*a* and 5*b* show clearly the locked position and the unlocked position of the pusher on the ring. In the locked position shown in FIG. 5*a*, the ribs 22 on the bushing 21 are disposed on the bearing surfaces 45 of the ring so the pusher cannot be actuated. In contrast, in the unlocked position of FIG. 5*b*, the ribs 22 are disposed in the vertical ducts 46 enabling the pusher to be pushed down on the ring.

By means of this locking system that uses three bearing points between the pusher and the ring, the pusher rests in particularly stable manner on the ring, so it can be used as a member for transmitting thrust while mounting the ring on the neck of the receptacle.

What is claimed is:

1. A fluid dispenser device comprising:

a dispenser member, provided with an actuator rod;

a pusher mounted to turn on and about the actuator rod and provided with a dispenser orifice, the dispenser being actuated by applying pressure to the pusher; and a fastening ring for fastening the dispenser member on a receptacle, said ring having fastening means for co-operating with a receptacle neck;

the fastening ring including at least one internal locking profile and the pusher includes at least one locking member engaged with said at least one internal profile to prevent the pusher being actuated, characterized in that the pusher comprises at least one inner bushing provided with said at least one locking member and an outer skirt concentric with the inner bushing and defining the dispenser orifice, the bushing penetrating into the fastening ring and the skirt being adapted to surround the fastening ring.

2. A fluid dispenser device according to claim 1, in which the internal profile comprises a locking bearing surface and a vertical actuation duct, the locking member being adapted to be moved selectively by turning the pusher about the actuation rod between a locked position in which the locking member bears against the locking bearing surface, and an actuation position in which the locking member is free to move vertically in the duct.

3. A fluid dispenser device according to claim 2, in which the internal profile defines at least one hard click at the bearing surface, the hard click being placed on the path of the locking member.

4. A fluid dispenser device according to claim 3, in which a hard click is situated between the bearing surface and the duct.

5. A fluid dispenser device according to claim 4, in which a hard click is situated close to an end of the bearing surface remote from the duct to define a socket at the end of the locking stroke.

6. A fluid dispenser device according to claim 1, in which the ring has three internal profiles and the pusher has three locking members that are distributed at equal angles.

7. A fluid dispenser device according to claim 1, in which at least one locking member is in the form of an outwardly-projecting rib.

8. A fluid dispenser device according to claim 1, in which the pusher is provided with a covering cap engaged around the skirt.

9. A fluid dispenser device according to claim 1, in which the fastening ring has snap-fastening tabs provided with snap-fastening heads which project inwards so as to be received beneath a thickening on a receptacle neck, a band of trim being mounted around the ring to prevent the tabs from deforming outwards.

* * * * *